US012723352B2

(12) United States Patent
Nylén et al.

(10) Patent No.: US 12,723,352 B2
(45) Date of Patent: Sep. 1, 2026

(54) METHOD FOR PRODUCING A FILM COMPRISING MICROFIBRILLATED CELLULOSE, AND A FILM COMPRISING MICROFIBRILLATED CELLULOSE

(71) Applicant: Stora Enso OYJ, Helsinki (FI)

(72) Inventors: Otto Nylén, Helsinki (FI); Isto Heiskanen, Imatra (FI); Jukka Kankkunen, Imatra (FI); Kaj Backfolk, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 173 days.

(21) Appl. No.: 18/690,070

(22) PCT Filed: Aug. 31, 2022

(86) PCT No.: PCT/IB2022/058163
§ 371 (c)(1),
(2) Date: Mar. 7, 2024

(87) PCT Pub. No.: WO2023/047216
PCT Pub. Date: Mar. 30, 2023

(65) Prior Publication Data

US 2024/0376670 A1 Nov. 14, 2024

(30) Foreign Application Priority Data

Sep. 22, 2021 (SE) ..... 2151162-1

(51) Int. Cl.
*D21H 11/08* (2006.01)
*D21H 19/34* (2006.01)
*D21H 25/12* (2006.01)

(52) U.S. Cl.
CPC ..... *D21H 11/08* (2013.01); *D21H 19/34* (2013.01); *D21H 25/12* (2013.01)

(58) Field of Classification Search
CPC ..... D21H 11/08
USPC ..... 162/206
See application file for complete search history.

(56) References Cited

FOREIGN PATENT DOCUMENTS

| | | | |
|---|---|---|---|
| JP | 2019052394 | A | 4/2019 |
| KR | 101784834 | B1 | 10/2017 |
| WO | 2009080872 | A1 | 7/2009 |
| WO | 2014091413 | A1 | 6/2014 |
| WO | 2018007673 | A1 | 1/2018 |
| WO | 2018211441 | A1 | 11/2018 |
| WO | 2019198040 | A1 | 10/2019 |
| WO | 2020095254 | A1 | 5/2020 |
| WO | 2022219377 | A1 | 10/2022 |

OTHER PUBLICATIONS

Extended European Search Report from corresponding European application No. 22872291.4 dated Jul. 17, 2025.
International search report from corresponding PCT application No. PCT/IB2022/058163, mailed Nov. 3, 2022.

*Primary Examiner* — Jacob T Minskey
(74) *Attorney, Agent, or Firm* — Greer, Burns & Crain, Ltd.

(57) ABSTRACT

The present invention relates to a method for producing a film comprising microfibrillated cellulose, which comprises: providing a suspension comprising 30-100 weight-% microfibrillated cellulose based on total dry weight: forming a wet web of said suspension by casting on a support being a non-porous support, paper or paperboard: wet-pressing said wet web to form a dewatered web, which comprises applying a press fabric into direct contact with said wet web and conducting said wet web, arranged between said press fabric and said non-porous support, through a pressing equipment: smoothening said dewatered web by applying at least one smoothing press to said dewatered web arranged on said non-porous support so as to form a smoothened web, wherein a pressure of 0.1-25 MPa is applied in each smoothing press, wherein said dewatered web has a dry content of 20-60% by weight when applying said smoothing press(es), and drying said smoothened web to form said film. The invention further relates to a film.

19 Claims, No Drawings

METHOD FOR PRODUCING A FILM COMPRISING MICROFIBRILLATED CELLULOSE, AND A FILM COMPRISING MICROFIBRILLATED CELLULOSE

This application is a U.S. National Phase under 35 U.S.C. § 371 of International Application No. PCT/IB2022/058163, filed Aug. 31, 2022, which claims priority under 35 U.S.C. §§ 119 and 365 to Swedish Application No. 2151162-1 filed Sep. 22, 2021.

TECHNICAL FIELD

The present invention relates to a method for producing a film comprising microfibrillated cellulose. In addition, the present invention relates to a film comprising microfibrillated cellulose obtainable by the method.

BACKGROUND

Films comprising a high amount of microfibrillated cellulose (MFC) have been known to have good strength and oxygen barrier properties. This is for example described by Syverud, "Strength and barrier properties of MFC films", Cellulose 2009 16:75-85, where MFC films with a basis weight of between 15-30 gsm were produced and the strength and barrier properties were investigated.

There are different techniques for producing barrier papers and films comprising a high amount of MFC. For example, methods for producing such barrier papers or films may comprise dewatering on a wire or cast coating on a non-porous carrier substrate. In both cases, regardless of the concept of the forming section, the wet web is further transferred to a press section. In the press section, more water is squeezed out from the wet web by conducting it through one or more pressing nips and/or contacting it with a press fabric on at least one of the sides. Since the solid content usually is fairly low when entering the press section, the material or film is not sufficiently immobilized. This means that applied pressure or suction will further shape the material. If the wet web is dewatered against a press fabric, the characteristic texture of the press fabric will be copied to the web surface. Thus, the porous or textured press fabric will leave marks on the wet web.

For some applications the marks left on the wet web may be preferred, since they give a special texture to the film. However, for many applications, the marks are not preferred or wanted. For example, this is due to the facts that marks formed on the wet web during press dewatering will give a two-sidedness, lead to small-scale thickness differences which may be optically detected and increase the risk of losing barrier properties. The latter is even more obvious when making thinner sheets (lower grammages).

Improving gloss and smoothness of paper and paperboard can be made by calendering of the material in a dry state, i.e., after drying. Number of nips, nip pressure, roll material, roll hardness, temperature, speed, moisture content and paper composition are some of the main variables affecting the calendering results. One essential effect in calendering is that fiber and structure collapses and that the surface is plasticized. For paper-like substrates with high density or high content of MFC or transparent or translucent materials/films, however, the effect of calendering is less evident. One reason for this is that e.g., hard nip calendering mainly affects the density profile and does not significantly influence lateral movement and distribution of material, which is believed to be more important for reducing the effect of wire and press fabric marks. Another reason for this is that the fiber network is different in substrates with high density or high content of MFC, in particular the lumen and other natural pores of normal fibers are lacking so the 3D structure will be very different.

One possible solution to improve smoothness of films comprising high amounts of MFC is to increase the line load in multiple hard nip calendering. However, a drawback with this solution is that it increases the risk for blackening, cracks and wrinkles, especially if the films comprise higher amounts of fibers.

Thus, there is still room for improvements of methods for production of an MFC film with improved smoothness.

DESCRIPTION OF THE INVENTION

It is an object of the present invention to provide an improved method for producing a film comprising microfibrillated cellulose with improved smoothness, which method eliminates or alleviates at least some of the disadvantages of the prior art methods.

The above-mentioned object, as well as other objects as will be realized by the skilled person in the light of the present disclosure, is achieved by the various aspects of the present disclosure.

The invention is defined by the appended independent claims. Embodiments are set forth in the appended dependent claims and in the following description.

According to a first aspect illustrated herein, there is provided a method for producing a film comprising microfibrillated cellulose, wherein the method comprises the steps of:

- providing a suspension comprising between 30 weight-% to 100 weight-% microfibrillated cellulose based on total dry weight;
- forming a wet web of said suspension by casting on a support, wherein said support is a non-porous support, a paper substrate or a paperboard substrate, wherein said formed wet web has a dry content of 1-25% by weight;
- wet-pressing said wet web so as to form a dewatered web having a dry content of 15-80% by weight, wherein said wet-pressing comprises applying a press fabric into direct contact with said wet web and conducting said wet web, arranged between said press fabric and said support, through a pressing equipment,
- smoothening said dewatered web by applying at least one smoothing press to said dewatered web arranged on said support so as to form a smoothened web, wherein a pressure of 0.1-25 MPa, preferably 0.1-15 MPa, most preferably 0.2-10 MPa, is applied in each smoothing press, wherein said dewatered web has a dry content of 20-60% by weight, preferably 25-60% by weight, most preferably 30-60% by weight, when said at least one smoothing press is applied, and
- drying said smoothened web so as to form said film.

It has surprisingly been found that it is possible to apply a smoothing press at a pressure of 0.1-25 MPa, preferably 0.1-15 MPa, most preferably 0.2-10 MPa, to a semi-wet dewatered web, which comprises MFC, such as a high amount of MFC, which has been dewatered in contact with a press fabric and which is present on the support on which it was casted, at a dry content of 20-60 weight-%, preferably 25-60% by weight, most preferably 30-60% by weight, in order to smoothen out any defects such as marks or textures from the press fabric copied to the wet web during the dewatering (i.e., copied to the side of the wet web being in contact with the press fabric) and obtain a film having an improved smoothness. In particular, it was surprisingly found that it is possibly to get rid of rather strong press fabric marks/imprints of semi-wet MFC webs by applying a smoothing press at a rather low pressure as described above. The smoothening according to the present disclosure evens out small-scale thickness variation in the dewatered web (i.e., at the side of the wet web that has been in contact with the press fabric) and should not, or essentially not, remove any moisture/water. The smoothening according to the present disclosure may also remove/reduce variations in thickness/grammage or quality caused by vibrational or pulsation effects. In addition, the smoothening according to the present disclosure may be important for cross direction (CD) and machine direction (MD) tension or shrinkage control.

Thus, by the application of the smoothening according to the present disclosure, it is possible to significantly reduce the roughness (increase smoothness) of wet-pressed webs at a relatively low pressure. In addition, it is also possible to control the smoothness variation. The improvement in smoothness or control of smoothness variation may be very important for ensuring higher level of smoothness after e.g., applying further coating or coatings, i.e., it may improve coating quality. A smoother film may imply a reduction of the number of pinholes after subsequent coating. Without being bound to any theory, it is also believed that the smoothing press influences e.g., drying shrinkage of the webs and hence profile and sheet properties. The smoothing press will also make the sheet more densified, or density more uniform, and hence improve thermal conductivity enabling better drying of the films.

In addition, the improvement in smoothness and the control of the smoothness variation may also be very important for reducing the risk of losing barrier properties and reducing two-sidedness.

When using calendering for evening out defects in a film according to prior art, the calendering is performed of a dry film, i.e., after drying of the dewatered web and at a high pressure, such as around 10-30 MPa. One essential effect in calendering is that fiber and structure collapses and that the surface is plasticized. For paper-like substrates with high density or high content of MFC or transparent or translucent materials/films, however, the effect of calendering is less evident. One reason for this is that e.g., hard nip calendering mainly affects the density profile and does not significantly influence lateral movement and distribution of material, which is believed to be more important for reducing the effect of wire and press fabric marks. Another reason for this is that the fiber network is different in substrates with high density or high content of MFC, in particular the lumen and other natural pores of normal fibers are lacking so the 3D structure will be very different. Thus, calendering cannot, or can at least not efficiently and easily, be utilized for removing defects such as texture and marks obtained from press dewatering with a press fabric.

The smoothening requires some residual moisture for providing the effect of evening out small-scale thickness variation. In addition, the moisture content must be high enough in order to avoid film damage and also attachment of film surface to the smoothing press.

The term film as used herein refers generally to a thin continuous sheet formed material, such as a thin substrate with good gas, aroma or grease or oil barrier properties, e.g., oxygen barrier properties. Depending on the composition of the suspension, the film can also be considered as a thin paper (e.g., nanopaper or micropaper) or even as a membrane. The film preferably has a grammage below 100 g/m$^2$, preferably in the range of 10-100 g/m$^2$ or 10-60 g/m$^2$. In some embodiments, the film has a thickness of 8-500 μm, preferably 10-200 μm, most preferably 15-100 μm, when dry. The film is typically relatively dense. In some embodiments, the film has a density of 700-1500 kg/m$^3$, preferably 800-1500 kg/m$^3$, most preferably 900-1500 kg/m$^3$ when dry. The film has preferably an Oxygen Transmission Rate (OTR) value at 23° C., 50% RH, below 15 cc/m$^2$/24 h, preferably below 10 cc/m$^2$/24 h, most preferably below 5 cc/m$^2$/24 h, according to ASTM D-3985.

The film can be used as such, or it can be combined with one or more other layers. The film is for example useful as a barrier film/layer in a paper or paperboard based packaging material. The film may also be or constitute a barrier layer in a multiply product comprising a base such as glassine, greaseproof paper, barrier paper or bioplastic films. Alternatively, the film can be comprised in at least one layer in a multiply sheet such as a liquid packaging board.

Paper generally refers to a material manufactured in thin sheets from the pulp of wood or other fibrous substances comprising cellulose fibers, used for writing, drawing, or printing on, or as packaging material.

Paperboard generally refers to strong, thick paper or cardboard comprising cellulose fibers used for boxes and other types of packaging. Paperboard can either be bleached or unbleached, coated or uncoated, and produced in a variety of thicknesses, depending on the end use requirements.

A paper or paperboard-based packaging material is a single ply or multiply packaging material formed mainly, or entirely from paper or paperboard. In addition to paper or paperboard, the paper or paperboard-based packaging material may comprise additional layers or coatings designed to improve the performance and/or appearance of the packaging material.

As mentioned above, the method of the first aspect of the present disclosure comprises a step of providing a suspension comprising between 30 weight-% to 100 weight-% microfibrillated cellulose based on total dry weight. The suspension is an aqueous suspension comprising a water-suspended mixture of cellulose based fibrous material and optionally non-fibrous additives.

Microfibrillated cellulose (MFC) shall in the context of the patent application mean a cellulose particle, fiber or fibril having a width or diameter of from 20 nm to 1000 nm.

Various methods exist to make MFC, such as single or multiple pass refining, pre-hydrolysis followed by refining or high shear disintegration or liberation of fibrils. One or several pre-treatment steps is usually required in order to make MFC manufacturing both energy efficient and sustainable. The cellulose fibers of the pulp used when producing MFC may thus be native or pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxidation, for example "TEMPO"), or quaternary ammonium (cationic cellulose). After being modified or oxidized in one of the above-described methods, it is easier to disintegrate the fibers into MFC.

MFC can be produced from wood cellulose fibers, both from hardwood or softwood fibers. It can also be made from microbial sources, agricultural fibers such as wheat straw pulp, bamboo, bagasse, or other non-wood fiber sources. It can be made from pulp, including pulp from virgin fiber, e.g., mechanical, chemical and/or thermomechanical pulps. It can also be made from broke or recycled paper.

In some embodiments, the suspension used in the method of the first aspect comprises between 40 weight-% to 100 weight-%, preferably between 50 weight-% to 100 weight-%, more preferably between 60 weight-% to 100 weight-%, even more preferably between 70 weight-% to 100 weight-%, most preferably between 80 weight-% to 100 weight-%, of microfibrillated cellulose based on total dry weight. Thus, a film produced from the dewatered and smoothened web in these embodiments comprises between 40-100% by weight of microfibrillated cellulose or a high amount of MFC such as between 50 weight-% to 100 weight-%, this relates to the amount of microfibrillated cellulose in the film per se before eventual coating layers have been added.

The microfibrillated cellulose of the suspension may comprise one or more fractions of microfibrillated cellulose. In some embodiments, the microfibrillated cellulose of the suspension comprises one fraction of microfibrillated cellulose of a fine grade. In some embodiments, the microfibrillated cellulose of the suspension comprises two or more fractions of microfibrillated cellulose of different fine grades. In some embodiments, the microfibrillated cellulose of the suspension comprises one fraction of a fine grade and one fraction of a coarse grade, wherein the coarse grade for example may be an additive. Coarse MFC in this case has typically a Schopper-Riegler value of 80-100 SR°, such as 80-99 SR° or 90-99 SR° or 95-99 SR°, whereas fine MFC is fibrillated so measurement of the Schopper-Riegler value is impossible (theoretical value about or above 100 SR°) as determined by standard ISO 5267-1.

In some embodiments, the suspension comprises one or more further cellulose pulp fractions in addition to the microfibrillated cellulose, such as e.g., a cellulose pulp fraction having a Schopper-Riegler value of $70 SR°, such as 15-70 SR° or 25-60 SR° as determined by standard ISO 5267-1 and/or a further fraction of normal fibers. The aqueous suspension may comprise, for example, 1-30 weight-%, more preferably 2-30 weight-%, most preferably 5-30 weight-% of further cellulose pulp fractions, based on the total dry weight of microfibrillated cellulose and further cellulose pulp fraction(s) (i.e., based on the total dry weight of total amount of fibers in the aqueous suspension).

By normal fibers is meant normal pulp fibers of a conventional length and fibrillation for papermaking. Normal fibers may include mechanical pulp, thermochemical pulp, chemical pulp such as sulphate (kraft) or sulphite pulp, dissolving pulp, recycled fiber, organosolv pulp or chemithermomechanical pulp (CTMP), or combinations thereof. The pulp may be bleached or unbleached. The normal fibers can be vegetable fibers, such as wood derived (e.g., hardwood or softwood) or agricultural sources including straw, bamboo, etc.

The normal fibers may have a beating degree, i.e., Schopper-Riegler value, in the range of 15 to 50 SR° or more preferably in the range of 18 to 40 SR° as determined by standard ISO 5267-1. The normal fibers may preferably be chemical pulp, such as kraft pulp.

The normal fibers may have an average length in the suspension of 1 mm to 5 mm, more preferably in the range of 2 to 4 mm.

In some embodiments, the suspension comprises 1-30 weight-%, preferably 2-30 weight-%, most preferably 5-30 weight-%, of reinforcement fibers based on the total dry weight of microfibrillated cellulose and further cellulose pulp fraction(s) (i.e., based on the total dry weight of total amount of fibers in the aqueous suspension), wherein the reinforcement fibers have a diameter of >10 μm and a length of >1.5 mm.

Thus, besides MFC, the suspension may also comprise longer fibers, either hardwood or softwood fibers, preferably kraft pulp softwood fibers.

The suspension may in addition to MFC and optional further pulp fraction(s) comprise any conventional paper making additives or chemicals such as fillers, pigments, wet strength chemicals, retention chemicals, cross-linkers, softeners or plasticizers, adhesion primers, wetting agents, biocides, optical dyes, colorants, fluorescent whitening agents, de-foaming chemicals, hydrophobizing chemicals such as AKD, ASA, waxes, resins, bentonite, stearate, wet end starch, silica, precipitated calcium carbonate, cationic polysaccharide, etc. These additives or chemicals may thus be process chemicals or film performance chemicals added to provide the end product film with specific properties and/or to facilitate production of the film.

Preferably, the suspension comprises no more than 35 weight-%, more preferably no more than 30 weight-%, most preferably no more than 25 weight-% of additives, based on total dry weight of the suspension. For example, the suspension may comprise 1-35 weight-% or 1-30 weight-% or 1-25 weight-% of additives, based on total dry weight of the suspension.

In some embodiments, the suspension comprises a water soluble polymer that can form a film and/or improve binding between cellulose fibrils. Typical examples of such polymers are natural gums or polysaccharides or derivatives thereof such as e.g., CMC, starch, or PVOH or analogues thereof.

In some embodiments, the suspension comprises 0.5-20 weight-% of a plasticizing agent based on total dry weight, such as sorbitol, glycol or other polyol.

In some embodiments, the suspension comprises up to 20% of mineral filler, such as bentonite, kaolin, talcum or montmorillonite.

As mentioned above, a wet web is formed from the suspension on a support on which the wet web is conducted through the pressing equipment and on which the dewatered web is conducted through the smoothing press(es). The wet web is formed on the support by casting, such as cast coating, the suspension onto the support.

The term "casting", when utilized in film-forming, is a known term designating methods wherein a suspension is deposited by means of contact or non-contact deposition and levelling methods on a support to form a wet web. Examples of such a deposition and levelling method are spray deposition, curtain coating/application or slot die casting. The wet web is after the casting dewatered and dried to form a film.

It is important to apply the suspension to the support in such a way that a homogeneous wet web is formed, meaning that the wet web should be as uniform as possible with as even thickness as possible etc. The thickness of the applied wet web may be, for example, 40-6000 μm or 60-3000 μm or 70-2000 μm or 100-2000 μm at application. The formed wet web has a dry content of 1-25% by weight, preferably 2-20% by weight, most preferably 3-15% by weight or 3-8% by weight, at formation (i.e., during application on the support or immediately after application on the support).

As mentioned above, the support on which the wet web is formed is a non-porous support, a paper substrate or a paperboard substrate.

The non-porous support (substrate) on which the wet web may be formed has preferably a smooth surface and may be a polymer/plastic support or metal support. In some embodiments, the support is a metal support, i.e., the support is made from metal, e.g., steel. Preferably, the non-porous support is a metal belt. The metal support is preferably heated to a temperature above 30° C., preferably between 30-150° C., more preferably between 45-150° C., even more preferred between 60-100° C. before or immediately after the web is applied to the support. By increasing the temperature of the support and thus on the applied web it has been found possible to further increase the efficiency of the dewatering of the web in the pressing equipment.

In embodiments in which the support on which the wet web is formed is a paper substrate or a paperboard substrate, the MFC film is formed on the paper or paperboard substrate, i.e., a coated paper or paperboard product, or a paper or paperboard laminate, is formed.

The formed wet web can be single or multilayer web or single ply or multiply web, made with one or several casting units. Thus, in some embodiments, the wet web comprises a single web layer or two or more web layers formed on top of each other.

As mentioned above, the method of the first aspect comprises a step of wet-pressing the wet web so as to form a dewatered web having a dry content of 15-80% by weight. For example, the step of wet-pressing the wet web may be performed so as to form a dewatered web having a dry content of 20-60% by weight or 25-60% by weight or 30-60% by weight. The wet-pressing comprises applying a press fabric into direct contact with the wet web and conducting the wet web, arranged between the press fabric and the support, through a pressing equipment. Thus, in embodiments in which the support is a non-porous support, the wet web formed during casting on the non-porous support remains on the non-porous support in the wet-pressing step. In embodiments in which the support is a paper substrate or a paperboard substrate, the paper substrate or paperboard substrate with the casted wet web is provided on a non-porous wet-pressing support in the step of wet-pressing.

With press fabric is meant a fabric that is permeable and allows water to be removed from the web either by absorbing the water or by allowing the water to be removed through the fabric. The press fabric may be a press felt (dewatering felt). Press fabrics and press felts are today often used for dewatering of paper and paperboard webs. Any known press fabric or press felt may be utilized.

It can be preferred to use more than one press fabric, i.e., two or more press fabrics subsequent to each other in the machine direction. If two or more press fabrics are utilized, the press fabrics may have the same or different construction and/or properties. For example, a first press fabric with low grammage and low water permeability that would prevent fines to penetrate through the press fabric and a second press fabric with high water absorption properties may be utilized. By different fabrics with different roughness, it would be possible to increase dewatering speed.

Each press fabric may comprise one fabric layer or two or more fabric layers. The fabric layers may have the same or different properties. In addition, each press fabric may comprise one or more batt material layers. The layers of press fabrics having multiple layers may be interwoven or arranged in a laminated or composite construction.

Furthermore, a supportive arrangement may be arranged on a second surface of each press fabric opposite a first surface of the press fabric arranged to be in contact with the wet web. The supportive arrangement may be arranged on the second surface of the press fabric before, after or at the time of application of the press fabric in contact with the wet web. In some embodiments, the supportive arrangement is attached to the second surface of the press fabric, such as in a laminated or composite construction. The supportive arrangement may comprise one or more batt material layers and/or supportive fabrics and/or one or more press felts. The supportive fabric(s) may be constituted by any suitable fabric. If there are more than one supportive fabric, they may be the same or different.

In one embodiment, the supportive arrangement consists of a press felt, i.e., a press felt is arranged on or attached to the second surface of the press fabric. In one embodiment, the supportive arrangement consists of a supportive fabric and a press felt, wherein the press felt preferably is arranged as an outermost layer.

In some embodiments, a press fabric comprising at least a first fabric layer which is woven, i.e., it comprises a woven first fabric layer, is utilized. The first fabric layer is intended to be in contact with the wet web to be dewatered. The woven first fabric layer comprises no batt (i.e., no batting material) or other filling material. Thus, the woven structure of the first fabric layer is a woven structure without batting material or other filling material. Thus, the woven first fabric layer constitutes a layer of the press fabric which provides a web-side surface structure, i.e., it is arranged such that one of its surfaces constitute a web-side first surface, which is the outer surface of the press fabric arranged to contact the wet web. However, one or more batt surface layers (or other surface layers) may be arranged on the surface of the first fabric layer opposite the web-side first surface. The press fabric comprising at least a first fabric layer may comprise one or more further fabric layers having the same or different properties as the first fabric layer. One or more of the further fabric layers may be woven layers but may alternatively have a woven or nonwoven base with batt of synthetic batting material. If one or more further fabric layers are woven, they may have different properties than the woven first fabric layer, e.g., be of a different weave pattern and/or of a different material. In some embodiments, the press fabric consists of the woven first fabric layer.

The woven first fabric layer is woven of a plurality of yarns, which may comprise or consist of polymeric yarns. Thus, it may be woven of a plurality of polymeric yarns, i.e., it may comprise or consist of a woven structure which is woven of a plurality of polymeric yarns. Furthermore, the polymeric yarns may be yarns of one or more synthetic polymer. The synthetic polymer(s) may be any known suitable synthetic polymers used for yarns of paper machine fabrics. Alternatively, cotton or rayon could be used as material for the yarns. The thickness of the woven first fabric layer may be, for example, 0.05-2 mm or preferably 0.1-1 mm. For example, the basis weight of the woven first fabric layer may be 30-1900 g/m$^2$ or 60-1400 g/m$^2$.

The press fabric is preferably applied to the wet web, i.e., in direct contact to the wet web, at least 20 cm before being conducted through the pressing equipment. It is preferred that the press fabric is applied to the wet web at a distance between 20 cm to 5 meters, even more preferable between 50 cm to 3 meters before the wet web is conducted through the pressing equipment. It is preferred that no external pressure is used on the press fabric when applied to the wet web before being conducted through the pressing equipment. It may be possible to wrap the support, the wet web and the press fabric around a roll and in this way create a small dewatering pressure but it is important not to use too high pressure and no pressure by the use of a nip roll/s can be used. By combining the use of a press fabric at a distance before increasing the dewatering in a pressing equipment, the dewatering of the web may be improved and clogging of the press fabric by fibrils of the microfibrillated cellulose moving into the press fabric may be further counteracted. In addition, it may then be possible to increase the pressure used in the pressing equipment and to increase the speed of the dewatering process.

Each press fabric is preferably cleaned and dewatered after being conducted through the pressing equipment.

With pressing equipment is meant an equipment forming a nip through which the wet web is conducted and thus pressed and dewatered. According to the present disclosure, the wet web is conducted through the pressing equipment arranged between the press fabric and the support. The pressing equipment may have a metal backing surface, which for example may be a hard roller. External loading elements may be utilized in order to press the non-porous support and the backing surface against each other to create the pressure. The pressing equipment preferably comprises an extended nip and it is preferred that the pressing equipment is a belt press. The belt press comprises a metal belt (i.e., the non-porous support on which wet web was casted or a non-porous wet-pressing support) and a roll and the dewatering of the web is done by applying the web and the press fabric between the metal belt and the roll. It may be preferred to increase the length of the nip by treating the wet web in the belt press for a distance of at least 20% of the diameter of the roll of the belt press. The pressing equipment may comprise more than one nip. In some embodiments, the pressing equipment comprises a low-pressure press nip followed by at least one high pressure press nip.

The pressure used in the pressing equipment is preferably between 0.01-15 MPa, preferably between 0.05-10 MPa, even more preferred between 0.1-6 MPa and even more preferred between 0.1-5 MPa. It may be preferred to gradually increase the pressure in the pressing equipment. It is preferred to use a pressure between 0.05-1 MPa in the beginning of the pressing equipment and gradually increase the pressure to 0.5-2 MPa and thereafter optionally further increase the pressure to 1-2 MPa followed by optionally increasing the pressure to between 2-5 MPa. The increased pressure may be done in the same pressure nip, e.g., in an extended nip or the pressing equipment may comprise more than one nip.

The web is preferably conducted through the pressing equipment at a speed of at least 20 m/min, preferably above 100 m/min and even more preferably above 200 m/min for the wet-pressing.

One or more pressing sections with pressing equipment may be utilized. Thus, more than one press fabric as described above may be utilized, such as two press fabrics in different pressing sections. If more than one press fabric is utilized, the different press fabrics may be the same or different. For example, the first press fabric may have a low water permeability whereas the second press fabric may have high water absorption properties.

The wet web is preferably heated before the press fabric is applied into contact. In this way the temperature and the solids content of the web is increased which further improves the subsequent dewatering of the web. The wet web has preferably a temperature of 10-99° C., preferably between 50-95° C., when entering wet-pressing. By increasing the temperature of the wet web, the viscosity of water can be lowered, which will aid the dewatering action. The increased heat may be applied using any known way. By increasing the solids content of the wet web before the wet pressing section, the surface of the wet web, coming into contact with the web-side surface of the press fabric, or the whole wet web becomes more viscous and its penetration (i.e., penetration of fine material) into pores of the press fabric can be reduced or avoided. However, higher solids content means usually that more pressure is applied which means that risk for press fabric markings is obvious.

In some embodiments, the method comprises a further step of pre-drying of the formed wet web on the support before the wet-pressing. In some embodiments, the step of pre-drying the wet web comprises drying the wet web by heating so that the dry content of the wet web is increased at least 1% by weight by evaporation before the step of applying the press fabric into direct contact with the wet web. For example, the heating may be performed by heating the support, i.e., a heated support may be utilized in the pre-drying step. Thus, in these embodiments, the wet web is pre-dried after formation of the wet web on the support but before application of the press fabric. For example, the pre-drying step may be necessary to perform when the dry content is 1-25% by weight, or 3-15% by weight or 3-10% by weight. For example, the pre-drying may be performed by evaporation, impingement drying with hot air, IR, microwaves, thermal heating or any other method well known in the art.

The dry content of the wet web when entering wet-pressing is preferably 3-25% by weight, more preferably 4-20% by weight, most preferably 5-15% by weight. The dry content of the wet web after dewatering in the pressing equipment is preferably 15-80% by weight, or 20-60% by weight or 25-60% by weight or 30-60% by weight or 30-55% by weight or 30-50% by weight.

In some embodiments, the method comprises a further step of subjecting the dewatered web to at least one step of pre-moisturizing before said smoothening step. The dewatered web is still arranged on the support during the pre-moisturizing step. The pre-moisturizing step may include steaming or vaporizing. The pre-moisturizing may be performed by using steam or water with or without chemicals. In some embodiments, 1-15 g/m$^2$, preferably 2-10 g/m$^2$, most preferably 2.5-8 g/m$^2$, steam or water is applied. In some embodiments, the temperature of the dewatered web may be increased by at least 10° C., or at least 20° C. during pre-moisturizing with steam or water. Thereby, the material may be easier to plasticize and restructure during the smoothening.

In some embodiments, the method comprises a further step of intermediate drying of the dewatered web before the smoothening step. Thus, in these embodiments, the dewatered web is dried on the support after the step of dewatering but before the step of smoothening. For example, the intermediate drying may be performed by evaporation, impingement drying with hot air, IR, microwaves, thermal heating, heating the support with steam or electricity or any other method well known in the art. A combination of different drying techniques may also be utilized.

As mentioned above, the method of the first aspect of the present disclosure comprises a step of smoothening the dewatered web by applying at least one smoothing press to the dewatered web arranged on the support so as to form a smoothened web. Thus, the dewatered web is, after the step of dewatering and the optional intermediate drying and the optional pre-moisturizing, smoothened in one or more smoothing presses when remaining on the support. Accordingly, the dewatered web is smoothened in at least one smoothing press by conducting the dewatered web arranged on the support on which it was casted through/past the at least one smoothing press. Thus, in embodiments in which the support is a non-porous support, the wet web formed during casting on the non-porous support remains on the non-porous support in the wet-pressing step and the smoothening step. In embodiments in which the support is a paper substrate or a paperboard substrate, the paper substrate or paperboard substrate with the casted wet web is provided on a non-porous wet-pressing support in the step of wet-pressing and is provided on the non-porous wet-pressing support or a non-porous smoothing support in the step of smoothening. The non-porous wet-pressing support and the non-porous smoothing support may be a polymer/plastic support or a metal support, such as a metal belt.

A pressure of 0.1-25 MPa, preferably 0.1-15 MPa, more preferably 0.2-10 MPa, is applied (used) in each smoothing press, i.e., the dewatered web is smoothened at a pressure of 0.1-25 MPa, preferably 0.1-15 MPa, more preferably 0.2-10 MPa. In some embodiments, a pressure of 0.1-20 MPa or 0.5-15 MPa or 0.5-10 MPa or 1-10 MPa is applied in each smoothing press.

The dewatered web has a dry content of 20-60% by weight, preferably 25-60% by weight, most preferably 30-60% by weight, when the at least one smoothing press is applied to the dewatered web, i.e., the dewatered web has a dry content of 20-60% by weight, preferably 25-60% by weight, most preferably 30-60% by weight, when entering the nip of each of the at least one smoothing press. A certain wet web strength is needed when applying the smoothing press, i.e., a wet web with too low dry content will not withstand the smoothening. In addition, some water/liquid is needed for making the web re-formable and re-shapable.

In some embodiments, the dewatered web has a dry content of 30-55% by weight or 30-50% by weight when the at least one smoothing press is applied to the dewatered web.

The mentioned dry content of the dewatered web when the at least one smoothing press is applied may be provided, or essentially provided, in the step of dewatering (i.e., it may result after the step of dewatering). Alternatively, the mentioned dry content may be provided, or essentially provided, as a result of (i.e., after) the step of dewatering and the optional step of intermediate drying. Still alternatively, the mentioned dry content may be provided, or essentially provided, as a result of (i.e., after) the step of dewatering and the optional step of pre-moisturizing. In another alternative, the mentioned dry content may be provided, or essentially provided, as a result of (i.e., after) the step of dewatering, the optional step of intermediate drying and the optional step of pre-moisturizing.

In some embodiments, the smoothening is performed by applying one smoothing press on the dewatered web. In some embodiments, the smoothening is performed by applying two or more consecutive smoothing presses on the dewatered web.

By applying at least one smoothing press at a pressure of 0.1-25 MPa, preferably 0.1-15 MPa, more preferably 0.2-10 MPa, to the dewatered web, which comprises MFC, such as a high amount of MFC, which has been dewatered in contact with the press fabric and which is present on the support on which it was casted, at a dry content of 20-60 weight-%, preferably 25-60% by weight, most preferably 30-60% by weight, any defects such as marks or textures from the press fabric copied to the wet web during the dewatering may be smoothened out. Thereby, it is possible to obtain an MFC film having an improved smoothness. It is also possible to control the smoothness variation. The smoothening according to the present disclosure evens out small-scale thickness variation in the dewatered web and should not, or essentially not, remove any moisture/water.

Thus, by the application of the at least one smoothing press according to the present disclosure, it is possible to significantly improve the roughness level (smoothness) of wet-pressed webs at a relatively low pressure. The improvement in smoothness may be very important for ensuring higher level of smoothness after e.g., applying further coating or coatings. The smoothing press will also make the sheet more densified and hence improve thermal conductivity enabling better drying of the films.

In addition, the improvement in smoothness and the control of the smoothness variation may also be very important for reducing the risk of losing barrier properties and reducing two-sidedness. Since the web is present on the support during the wet-pressing, the surface of the web positioned adjacent to the support will not be provided with defects such as marks and texture provided by the press fabric (i.e., it will be much smoother after wet-pressing than the surface of the web provided in direct contact with the press fabric). By the smoothening according to the present disclosure the smoothness difference between the two surfaces of the web may be reduced, i.e., the two-sidedness may be reduced.

Each smoothing press comprises a smoothing element arranged to be in contact with the dewatered web and compress the dewatered web between the smoothing element and the support. The smoothing element may comprise a polished or non-polished metal surface arranged be in contact with the dewatered web. The smoothing element may be a smoothing roll or a smoothing belt. The smoothing roll or the smoothing belt is applied in contact with the dewatered web having a dry content as mentioned above, present on the support at a pressure as mentioned above. Thus, the smoothing roll or the smoothing belt is applied in contact with the side (first side) of the dewatered web that has been in contact with the press fabric during the dewatering, i.e., the smoothing roll or the smoothing belt is applied in contact with the side of the dewatered web opposite the side (second side) in contact with the support.

In some embodiments, at least one of the at least one smoothing press comprises a smoothing roll being a soft roll. In some embodiments, the smoothing is performed by one smoothing press comprising a soft roll. In some embodiments, the smoothing is performed by two or more smoothing presses, wherein each smoothing press comprises a soft roll. Alternatively, or additionally, at least one smoothing press comprises a smoothing roll being a hard roll.

In some embodiments, at least one of the at least one smoothing press comprises an extended nip. For example, the dwell time in the extended nip may be more than 5 milliseconds.

Any suitable tilting angle for the dewatered web for entering and leaving each of the at least one smoothing press may be utilized.

In some embodiments, at least one of the at least one smoothing press comprises a counter element (loading element) arranged on the opposite side of the support compared to dewatered web. In some embodiments, each smoothing press comprises a counter element.

In some embodiments, at least one of the at least one smoothing press comprises a smoothing roll and a counter roll, wherein the counter roll is arranged on the opposite side of the support compared to the smoothing roll (and compared to the dewatered web). In some embodiments, the smoothening is performed by two or more smoothing presses, wherein each smoothing press comprises a smoothing roll and a counter roll.

In some embodiments, each smoothing press has a temperature of 40-200° C., preferably 40-150° C., more preferably 60-150° C., most preferably 70-150° C. In some embodiments, each smoothing press has a temperature of 40-99° C. Elevated temperatures lower the viscosity of the MFC in the web and makes it more formable.

In some embodiments, each smoothing press has a temperature of at least 1° C., preferably at least 5° C., most preferably at least 10° C., higher than the dewatered web during the smoothening.

In some embodiments, at least one of the at least one smoothing press comprises a washer and/or doctor blade for cleaning.

In some embodiments, at least one of the at least one smoothing press is equipped with a heating applicator and/or a steam applicator and/or a spray applicator for application of a release agent or an adhesive and/or a spreading roll for application of a release agent or an adhesive. In some embodiments, at least one smoothing element/roll can be permanently coated with a substance promoting release of the smoothened web from the smoothing element/roll surface, such as PTFE-coating.

After smoothening in the at least one smoothing press, the smoothened web is dried so as to form the film. The drying may be performed by non-contact and/or contact drying. The drying of the smoothened web may comprise drying in any conventional way, e.g., by additional pressing or contacting the web with hot or warm cylinder or metal belt, by using vacuum, by irradiation drying and/or by the use of hot air (such as by the use of impingement drying) and/or heating of the support from below with steam or any other media, in order for it to have the appropriate dry content. The moisture content of the dry film is preferably 0.5-15% by weight, more preferably 1-12% by weight, most preferably 1.5-10% by weight.

In some embodiments, the method comprises a further step of calendering the film after the step of drying. Any suitable calender may be utilized in these embodiments, such as e.g., a soft nip calender.

The method of the present disclosure may further comprise a step of peeling off the formed film from the non-porous support after the drying step, preferably at a dryness of <20% by weight. A free-standing film is thereby formed. Thus, the method of the present disclosure may be a method for production of a free-standing MFC film.

In some embodiments, a first side of the produced MFC film, i.e., the side of the MFC film that has been in contact with the press fabric and that has been smoothened in the at least one smoothening press, has a Bendtsen roughness of 300 ml/min or less, preferably 250 ml/min or less or 150 ml/min or less, as measured by ISO 8791-2:2013. A second opposite side of the produced MFC film, i.e., the side of the MFC film that has been in contact with the support may also have a Bendtsen roughness of 300 ml/min or less, preferably much lower (such as 0-100 ml/min) depending on the support used, but may alternatively have a Bendtsen roughness above 300 ml/min. In some embodiments, the first side of the produced film has a higher roughness than the second side of the film. In some embodiments, a ratio between the Bendtsen roughness for the first side and the Bendtsen roughness for the second side is less than 6, preferably less than 4, most preferably less than 3. In some embodiments, the second side of the produced film has a higher roughness than the first side of the produced film.

According to a second aspect of the present disclosure there is provided an MFC film obtainable by the method of the first aspect. Preferably, both a first side and an opposite second side of the film has a Bendtsen roughness of 300 ml/min or less, preferably 250 ml/min or less or 150 ml/min or less, as measured by ISO 8791-2:2013. The first side of the film may have a higher roughness than the second side of the film. In some embodiments a ratio between the Bendtsen roughness for the first side and the Bendtsen roughness for the second side is less than 6, preferably less than 4, most preferably less than 3. Alternatively, the second side of the film may have a higher roughness than the first side of the film. The MFC film has preferably a grammage of 10-100 gsm when dry. The thickness of the MFC film is preferably 8-500 μm, preferably 10-200 μm, most preferably 15-100 μm, when dry. The density of the MFC film is preferably 700-1500 kg/m$^3$, preferably 800-1500 kg/m$^3$, most preferably 900-1500 kg/m$^3$ when dry. The film may have a transparency over 80% according to DIN 53147. Preferably, the film has ≤1 pinhole/m$^2$ according to EN13676:2001 when being uncoated.

According to a third aspect of the present disclosure, there is provided a film comprising between 30 weight-% to 100 weight-% microfibrillated cellulose based on total dry weight, wherein both a first side and an opposite second side of the film has a Bendtsen roughness of 300 ml/min or less, preferably 250 ml/min or less or 150 ml/min or less, as measured by ISO 8791-2:2013. The first side of the film may have a higher roughness than the second side of the film. In some embodiments, a ratio between the Bendtsen roughness for the first side and the Bendtsen roughness for the second side is less than 6, preferably less than 4, most preferably less than 3. Alternatively, the second side of the film may have a higher roughness than the first side of the film. The MFC film has preferably a grammage of 10-100 gsm when dry. The thickness of the MFC film is preferably 8-500 μm, preferably 10-200 μm, most preferably 15-100 μm, when dry. The density of the MFC film is preferably 700-1500 kg/m$^3$, preferably 800-1500 kg/m$^3$, most preferably 900-1500 kg/m$^3$ when dry. The film may have a transparency over 80% according to DIN 53147. Preferably, the film has ≤1 pinhole/m$^2$ according to EN13676:2001 when being uncoated.

The film according to the third aspect may be further defined as set out above with reference to the method of the first aspect.

A free-standing MFC film according to the present disclosure may be applied to the surface of any one of a paper product and a paperboard product so as to form a laminate, such as a paper or paper-based packaging material laminate.

A free-standing MFC film according to the present disclosure may also be utilized in a laminate together with one or more polymer layers, such as termoplastic polymer layers. For example, the one or more additional polymer layers may be constituted by any suitable polyolefin or polyester. The additional polymer layer(s) can be provided e.g., by extrusion coating, film coating or lamination or dispersion coating. Common plastic resins used in extrusion coating include polyethylene (PE), polypropylene (PP) polyethylene terephthalate (PET), polylactic acid (PLA), polyglycolic acid (PGA), polyhydroxyalkanoates (PHA) and polybutylene succinate (PBS).

The MFC film can also be part of a flexible packaging material, such as a free-standing pouch or bag, which may be transparent or translucent. Thus, the MFC film according to the present disclosure may be used as bag material in boxes when packaging dry food such as cereals. Furthermore, the MFC film according to the present disclosure may be used as a wrapping substrate, as a laminate material in paper, paperboard or plastics and/or as a substrate for disposable electronics. The MFC film may also be included in for example a closure, a lid or a label. The MFC film can be incorporated into any type of package, such as a box, bag, a wrapping film, cup, container, tray, bottle etc.

According to a fourth aspect of the present disclosure, there is provided a laminate comprising a film comprising microfibrillated cellulose laminated to a paper or paperboard material obtainable by the method according to the present disclosure.

According to a fifth aspect of the present disclosure, there is provided a laminate comprising a film, which comprises between 30 weight-% to 100 weight-% microfibrillated cellulose based on total dry weight, laminated with a paper or paperboard material, wherein a first side (which is opposite a second side of the film laminated with the paper or paperboard material) has a Bendtsen roughness of 300 ml/min or less, preferably 250 ml/min or less or 150 ml/min or less, as measured by ISO 8791-2:2013.

The laminate according to the fifth aspect may be further defined as set out above with reference to the method of the first aspect.

In view of the above detailed description of the present invention, other modifications and variations will become apparent to those skilled in the art. However, it should be apparent that such other modifications and variations may be effected without departing from the spirit and scope of the invention.

EXAMPLES

A number of examples were performed to show the effect of the smoothening according to the present disclosure. Data and results of the examples are shown in Tables 1a-b below.

Example 1—(Comparative)—Low Solids Content after Pressing, No Smoothening

In Example 1, an MFC film comprising 13 weight-% Sorbitol and 87 weight-% MFC (enzymatically treated kraft pulp which was fluidized and microfibrillated) based on total dry weight was prepared using a cast coating method. The furnish was cast coated on a metal belt, which acted first as the forming section and then as a web carrier in a press section. Press section was arranged between metal belt (casting substrate), press fabric, and a metal surface coming into contact with the press fabric. There was a loading element below the metal belt casting substrate as counter surface in the press section. The press section had first low pressure press nip and high pressure press nip with same press arrangement. In low pressure press nip 0.2 MPa pressure was used, and dwell time was 1000 ms. In high pressure press nip 6.2 MPa pressure was used, and dwell time was 1000 ms. Press fabric was a two-layer press fabric, where first layer coming into contact with the film surface was a smooth woven layer, and second layer coming into contact with the metal surface was needled press felt. After casting on metal belt and before pressing the film underwent pre-drying to increase solids content from 3% to 5.6%. The pre-drying was carried out with hot air impingement. After pressing the solids content (dry content) was 31%. The final drying after pressing was carried out with hot air impingement to reach 95% solids content. No smoothing press was used and Bendtsen roughness (ISO 8791-2:2013) of the press fabric side of the film after drying was 1350 ml/min. The solids content after wet press was low, i.e., 31%. The Bendtsen roughness for the belt side of the film after drying was 20 ml/min. The Oxygen Transmission Rate (OTR) value was measured at 23° C., 50% RH, according to ASTM D-3985

Example 2—(comparative)—Medium Solids Content after Pressing, No Smoothening Example 2 was performed in the same way as Example 1 but the solids content after wet pressing was improved (increased). Roughness was slightly improved and reached a value of 810 ml/min for the press fabric side of the film after drying.

Example 3—(comparative)—High Solids Content after Pressing, No Smoothing

Example 3 was performed in the same way as Example 1 but the solids content after wet pressing was improved (increased) to 52%. Roughness was slightly improved and reached a value of 680 ml/min for the press fabric side of the film after drying.

Example 4—Smoothing Press: High Start Solids Content, High Pressure

The same recipe and forming and press section as in Example 1 were utilized in Example 4 but now with a smoothing press applied after the press section. The smoothing press was arranged so that the web was compressed between metal belt casting substrate and a polished smooth metal surface that was the upper portion of the smoothing press. The temperature of the metal belt and upper portion of the smoothing press was 50° C. There was a loading element below the metal belt casting substrate as counter surface in the press. The solids content after press section (and thus the solids content when the smoothing press was applied) was 43% and the drying was performed with hot air impingement. Applied smoothing pressure was 5.3 MPa. A significant reduction in the Bentdsen roughness (ISO 8791-2:2013) for the press fabric side of the film after drying was obtained (60 ml/min) indicating that smoothening was successful. The Bendtsen roughness for the belt side of the film after drying was 20 ml/min.

Example 5—Smoothing Press: High Start Solids Content, Medium Pressure

Example 5 was performed in the same way as Example 4 but now with lower smoothing press pressure, i.e., 3.5 MPa. This gave as good results as in Example 4 concerning the Bendtsen roughness for the press fabric side of the film after drying (40 ml/min).

Example 6—Smoothing Press: High Start Solids Content, Low Pressure

Example 6 was performed in the same way as Example 4 but now with even lower smoothing press pressure, i.e., 1.5 MPa. Smoothness for the press fabric side of the film after drying is still significantly better than the corresponding reference (90 ml/min).

Example 7—Smoothing Press: Very High Start Solids Content, High Pressure

Example 7 was performed in the same way as Example 4 but with higher solids content after press section, i.e., >66%.

The smoothing press pressure was 6.7 MPa. This was an unsuccessful example and it was shown that smoothening with smoothing press does not work with too dry film. The samples with these conditions have high surface roughness on press fabric side of the film.

Example 8—Smoothing Press: High Start Solids Content, Very High Pressure

Example 8 was performed in the same way as Example 4 but with a higher smoothing press pressure, i.e., 11.4 MPa. This was an unsuccessful example and it was shown that smoothening with smoothing press with too high pressure destroys the film. The samples with these conditions all have pinholes/holes.

Example 9—Smoothing Press: High Start Solids Content, Very Low Pressure

Example 9 was performed in the same way as Example 4 but with a lower smoothing press pressure, i.e., 0.5 MPa. Roughness on same level as the previous samples.

Example 10—Smoothing Press: Low Start Solids Content, High Pressure

Example 10 was performed in the same way as Example 4 but with a lower solid content after press section, i.e., 29%. The smoothing press pressure was 5 MPa. The smoothening effect is somewhat similar as in Example 4.

Example 11—Smoothing Press: Very Low Start Solids Content, Low Pressure

Example 11 was performed in the same way as Example 4 but with a lower solid content after press section, i.e., 26%. The smoothening effect is somewhat similar as in Example 4.

Example 12—Different Smoothing Press Surfaces: High Start Solids Content, High Pressure Example 12 was performed in the same way as Example 4 but with non-polished ground metal plate as surface on the upper portion of smoothing press. The smoothing press pressure was 5.3 MPa. The smoothening effect is somewhat similar as in Example 4.

Example 13—Smoothing Press: High Starting Solids Content (Intermediate Drying), High Pressure Example 13 was performed in the same way as Example 4, but with intermediate drying before smoothing press. The smoothing press pressure was 5.1 MPa. Roughness on same level as the previous samples.

TABLE 1a

| Ex. No. | Solids content before wet-pressing % | Solids content after wet-pressing % | Solids content before smoothing press % | Smoothing press used Yes/No | Smoothing press pressure MPa |
|---|---|---|---|---|---|
| 1 | 5.6% | 31% | 31% | No | |
| 2 | 5.5% | 47% | 47% | No | |

TABLE 1a-continued

| Ex. No. | Solids content before wet-pressing % | Solids content after wet-pressing % | Solids content before smoothing press % | Smoothing press used Yes/No | Smoothing press pressure MPa |
|---|---|---|---|---|---|
| 3 | 5.5% | 52% | 52% | No | |
| 4 | 5.6% | 43% | 43% | Yes | 5.3 |
| 5 | 5.3% | 42% | 42% | Yes | 3.5 |
| 6 | 5.5% | 42% | 42% | Yes | 1.5 |
| 7 | n.a. | >66% | >66% | Yes | 6.7 |
| 8 | 5.1% | 41% | 41% | Yes | 11.4 |
| 9 | 5.2% | 43% | 43% | Yes | 0.5 |
| 10 | 5.6% | 29% | 29% | Yes | 5 |
| 11 | 6.3% | 26% | 26% | Yes | 1.8 |
| 12 | 6.0% | 43% | 43% | Yes | 5.3 |
| 13 | 5.5% | 39% | 49% | Yes | 5.1 |

TABLE 1b

| Ex. No. | Bendtsen roughness (ISO 8791-2:2013) ml/min | Pinholes | Oxygen transmission rate cc/m$^2$/24 h |
|---|---|---|---|
| 1 | 1350 | no | n.a. |
| 2 | 810 | no | 3.5 |
| 3 | 680 | no | n.a. |
| 4 | 60 | no | 3.3 |
| 5 | 40 | no | 3.3 |
| 6 | 90 | no | 3.3 |
| 7 | 580 | no | n.a. |
| 8 | 80 | yes | above range |
| 9 | 120 | no | 3.3 |
| 10 | 50 | no | 3.3 |
| 11 | 80 | yes | above range |
| 12 | 40 | no | n.a. |
| 13 | 40 | no | n.a. |

The invention claimed is:

1. A method for producing a film comprising microfibrillated cellulose, wherein the method comprises the steps of:

providing a suspension comprising between 30 weight-% to 100 weight-% microfibrillated cellulose based on a total dry weight;

forming a wet web of said suspension by casting on a support, wherein said support is a non-porous support, a paper substrate or a paperboard substrate, wherein said wet web has a dry content of 1-25% by weight;

wet-pressing said wet web so as to form a dewatered web having a dry content of 15-80% by weight, wherein said wet-pressing comprises applying a press fabric into direct contact with said wet web and conducting said wet web, arranged between said press fabric and said support, through a pressing equipment, smoothening said dewatered web so as to form a smoothened web, wherein said smoothening comprises applying at least one smoothing press to said dewatered web arranged on said support, each smoothing press comprises a smoothing element arranged to be in direct contact with said dewatered web, and compressing said dewatered web between said smoothing element and said support, wherein a pressure of 0.1-25 MPa is applied in each smoothing press, wherein said dewatered web has a dry content of 20-60% by weight when said at least one smoothing press is applied, and drying said smoothened web so as to form said film.

2. The method according to claim 1, wherein said smoothening is performed by applying two or more consecutive smoothing presses on said dewatered web.

3. The method according to claim 1, wherein each smoothing press comprises a smoothing roll or a smoothing belt.

4. The method according to claim 1, wherein at least one smoothing press comprises a smoothing roll being a soft roll.

5. The method according to claim 1, wherein at least one smoothing press comprises an extended nip.

6. The method according to claim 1, wherein at least one smoothing press comprises a smoothing roll and a counter roll arranged on an opposite side of said support.

7. The method according to claim 1, wherein each smoothing press has a temperature of 40-200° C.

8. The method according to claim 1, wherein each smoothing press has a temperature of at least 1° C. higher than said dewatered web during said smoothening.

9. The method according to claim 1, wherein said non-porous support is a metal belt.

10. The method according to claim 1, wherein said support is said paper substrate or said paperboard substrate, wherein said paper substrate or paperboard substrate is provided on a non-porous wet-pressing support in said step of wet-pressing, and wherein said paper substrate or said paperboard substrate is provided on said non-porous wet-pressing support or a non-porous smoothing support in said step of smoothening.

11. The method according to claim 1, wherein said suspension comprises between 50 weight-% to 100 weight-% of microfibrillated cellulose based on the total dry weight.

12. The method according to claim 1, wherein said suspension further comprises 0.5-20 weight-% of a plasticizing agent based on the total dry weight.

13. The method according to claim 1, wherein said suspension further comprises 1-30 weight-% of reinforcement fibers having a diameter of >10 μm and a length of >1.5 mm.

14. The method according to claim 1, wherein said formed wet web comprises a single web layer or two or more web layers formed on top of each other.

15. The method according to claim 1, wherein said dewatered web is subjected to at least one step of pre-moisturizing before said smoothening step.

16. The method according to claim 1, wherein said drying is performed by non-contact drying, or contact drying, or both.

17. The method according to claim 1, wherein said film is calendered after said step of drying.

18. The method according to claim 1, further comprising a step of pre-drying of said formed wet web before said wet-pressing step.

19. The method according to claim 1, further comprising a step of intermediate drying of said dewatered web before said smoothening step.

* * * * *